US007455074B2

(12) United States Patent
Shelby et al.

(10) Patent No.: US 7,455,074 B2
(45) Date of Patent: Nov. 25, 2008

(54) LATCHABLE ELECTROHYDRAULIC SERVOVALVE

(75) Inventors: Jeffrey Dugan Shelby, South Bend, IN (US); Paul W. Futa, Jr., North Liberty, IN (US); Matthew A. Arend, South Bend, IN (US)

(73) Assignee: Honeywell International Inc., Morristown, NJ (US)

( * ) Notice: Subject to any disclaimer, the term of this patent is extended or adjusted under 35 U.S.C. 154(b) by 303 days.

(21) Appl. No.: 11/492,845

(22) Filed: Jul. 26, 2006

(65) Prior Publication Data

US 2007/0023093 A1 Feb. 1, 2007

Related U.S. Application Data

(60) Provisional application No. 60/702,995, filed on Jul. 28, 2005.

(51) Int. Cl.
*F15B 13/04* (2006.01)

(52) U.S. Cl. ..... 137/625.63; 137/625.66

(58) Field of Classification Search ..... 137/625.63, 137/625.64, 625.66
See application file for complete search history.

(56) References Cited

U.S. PATENT DOCUMENTS 3,054,388 A * 9/1962 Blanton ..... 137/625.63
3,282,283 A * 11/1966 Takeda ..... 137/625.63
3,391,611 A 7/1968 Jenney
3,406,702 A 10/1968 Jenney
3,437,101 A * 4/1969 Kubilos et al. ..... 137/625.63
3,542,051 A * 11/1970 McFadden et al. ..... 137/625.63
3,570,516 A 3/1971 Mason
3,584,638 A * 6/1971 Cobb et al. ..... 137/625.63
3,736,958 A * 6/1973 Rostad ..... 137/625.66
3,910,314 A * 10/1975 Nicholson ..... 137/625.64
3,922,955 A * 12/1975 Kast ..... 137/625.62
4,227,443 A * 10/1980 Toot ..... 137/625.62
4,232,699 A 11/1980 Hsu
4,285,363 A * 8/1981 Kolm ..... 137/625.64
4,368,750 A * 1/1983 Burton ..... 137/625.63
4,378,031 A * 3/1983 Nicholson et al. ..... 137/625.63
5,156,189 A 10/1992 Tranovich (Continued)

FOREIGN PATENT DOCUMENTS

GB 2030325 4/1980

*Primary Examiner*—John Rivell
*Assistant Examiner*—Craig Price
(74) *Attorney, Agent, or Firm*—Ingrassia, Fisher & Lorenz, P.C.

(57) ABSTRACT

An electro-hydraulic servovalve (EHSV) (10) that includes a nozzle (16), a motor (12) operably connected to the nozzle (16) for controlling the position of the nozzle (16) based on current provided to the motor (12), a spool (18) having first and second ends (22,26) slidably mounted in a sleeve (34) having first and second ends (31,33) and a first land (21) near the first end (22), a first passage (40) extending from near the nozzle (16) to the first end (31) of the sleeve (34), a second passage (42) extending from near the nozzle (16) to the second end (33) of the sleeve (34), the spool (18) shifting to a first fail-safe position when the current is below a first predetermined level and latching in a second fail-safe position different than the first fail-safe position when the current exceeds a second predetermined level greater than the first predetermined level.

14 Claims, 1 Drawing Sheet

U.S. PATENT DOCUMENTS

| | | | |
|---|---|---|---|
| 5,735,122 | A | 4/1998 | Gibbons |
| 5,784,884 | A | 7/1998 | Poerio et al. |
| 6,637,199 | B2 | 10/2003 | Spickard |
| 6,981,359 | B2 | 1/2006 | Wernberg et al. |
| 7,003,949 | B2 | 2/2006 | Fenny et al. |
| 2002/0100511 | A1 | 8/2002 | Brocard et al. |
| 2004/0221896 | A1 | 11/2004 | Ballenger et al. |
| 2005/0022498 | A1 | 2/2005 | Futa et al. |
| 2005/0279079 | A1 | 12/2005 | Baryshnikov et al. |
| 2006/0021324 | A1 | 2/2006 | Eick et al. |

* cited by examiner

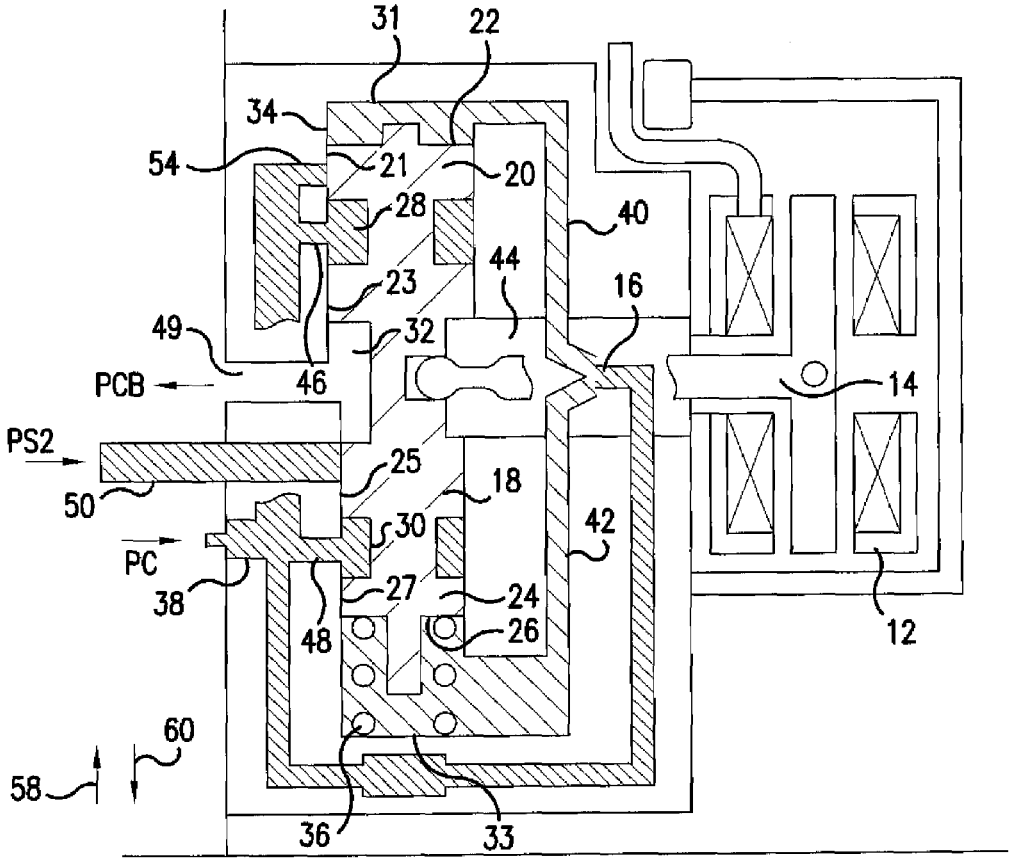
Figure

LATCHABLE ELECTROHYDRAULIC SERVOVALVE

CROSS REFERENCE TO RELATED APPLICATIONS

The present application claims the benefit of U.S. Provisional Patent Application No. 60/702,995, filed Jul. 28, 2005, the entire contents of which is hereby incorporated by reference.

FIELD OF THE INVENTION

The present invention is directed toward a latchable electrohydraulic servovalve (EHSV) and more specifically, toward a two-stage EHSV having a spool that can be hydraulically latched in a predetermined position upon application of a given command signal to the EHSV motor.

BACKGROUND OF THE INVENTION

Two-stage EHSV's are well known. These EHSV's include a first stage or torque motor that is controllable to affect the position of a second stage or spool by moving a nozzle to control the balance of first and second stage fluid flows against opposite ends of the spool. In the event of a power loss, the torque motor null bias moves the nozzle to a known position. This known position may be used as a fail-safe position in which the system can safely exist until power is restored. Such systems, however, do not maintain the spool in a given position after power is restored. It would therefore be desirable to provide an EHSV second stage that can be latched in a fail-safe position and maintained in such a position independently of the power applied to the motor.

SUMMARY OF THE INVENTION

This problem and others are addressed by the present invention, which comprises, in a first aspect, an electro-hydraulic servovalve (EHSV) that includes a nozzle, a motor operably connected to the nozzle for controlling the position of the nozzle, and a spool having first and second ends slidably mounted in a sleeve having first and second ends and a first land near the spool first end. A first passage extends from near the nozzle to the first end of the sleeve, a second passage extends from near the nozzle to the second end of the sleeve, and a latching passage is located near the first end of the sleeve. The motor has a null bias such that when current provided to the motor is 0 or below a low level, the motor moves the nozzle toward the second passage and the spool toward a first fail-safe position. The first land blocks the latching passage when a current to the motor is below a predetermined level but opens the latching passage to the sleeve first end when the current exceeds the predetermined level to drive the spool to a second fail-safe position different from the first fail-safe position.

Another aspect of the invention comprises an electro-hydraulic servovalve (EHSV) that includes a nozzle, a motor operably connected to the nozzle for controlling the position of the nozzle based on current provided to the motor, and a spool having first and second ends slidably mounted in a sleeve having first and second ends and a first land near the first end. A first passage extends from near the nozzle to the first end of the sleeve, and a second passage extends from near the nozzle the second end of the sleeve. The spool shifts to a first fail-safe position when the current is below a first predetermined level and latches in a second fail-safe position different than the first fail-safe position when the current exceeds a second predetermined level greater than the first predetermined level.

An additional aspect of the invention is an electro-hydraulic servovalve (EHSV) that includes a nozzle and a motor operably connected to the nozzle for controlling the position of the nozzle based on a current provided to the motor. The EHSV also includes a spool having first and second ends, a first portion of the spool including the first end and having a first diameter and a second portion of the spool including the second end and having a second diameter less than the first diameter. The spool is slidably mounted in a sleeve having a first portion having a first end opposed to the spool first end and a second portion having a second end opposed to the spool second end, and the spool further includes a central groove, first and second lands on the first portion between the first end and the central groove, a first lubricating channel between the first and second lands, third and fourth lands between the central groove and the second end, and a second lubricating channel between the third and fourth lands. The EHSV also includes a first passage extending from near the nozzle to the first end of the sleeve, a second passage extending from near the nozzle to the second end of the sleeve, a third passage extending from near the nozzle through the central channel and to an outlet, a latching passage connected to the sleeve first portion, and a fourth passage connected to the sleeve second portion. The spool is shiftable between a first fail-safe position, an operating position, and a second fail-safe position. In the operating position, the first land blocks the latching passage and the third land blocks the fourth passage. In the first fail-safe position, the third land blocks the fourth passage, and in the second fail-safe position, the latching passage is open to the sleeve first portion and the fourth passage is open to the central channel.

BRIEF DESCRIPTION OF THE DRAWING

The FIGURE is a schematic side elevational view of a latchable EHSV according to an embodiment of the present invention.

DETAILED DESCRIPTION

Referring now to the drawing, wherein the showings are for purposes of illustrating a preferred embodiment of the invention only and not for the purpose of limiting same, the FIGURE illustrates a two-stage EHSV 10 that includes a first stage or torque motor 12 that controls the position of a rod 14 connected to a nozzle 16. EHSV includes a second stage or spool 18 having a first portion 20 having a first diameter and a first end 22, and a second portion 24 having a second diameter and a second end 26. First portion 20 further includes a first land 21 a second land 23 and a first lubrication channel 28, second side 24 includes a third land 25, a fourth land 27 and a second lubrication channel 30, and a central channel 32 is located between second land 23 and third land 25. Spool 18 is mounted for sliding movement in a sleeve 34 having a first end 31 and a second end 33, and EHSV 10 includes a spring 36 biasing second end 26 of spool 18 away from the second end 33 of cylinder 34.

A fluid inlet passage 38 provides fluid at pressure PC to nozzle 16 which fluid enters a first pathway 40 leading to first end 22 of spool 18, a second pathway 42 leading to second end 26 of spool 18 or enters a central chamber 44 that surrounds nozzle 16. The diameter of first portion 20 is larger than the diameter of second portion 24, and spring 36 helps compensate for the greater force applied against first end 22 of spool 18 when nozzle 16 provides equal fluid flows to each of the first and second pathways 40, 42.

Fluid from inlet passage 38 is applied to first lubrication passage 28 and second lubrication passage 30 by a first connecting passage 46 and a second connecting passage 48, respectively, to provide lubrication for spool 18. Fluid from central chamber 44 flows past spool 18 through central channel 32 and out an exit passage 49 at pressure PCB. A second inlet 50 carries fluid at pressure P2S and is blocked by a third land 25 under normal operating conditions. Finally, a latching passage 54 is provided from fluid inlet passage 38 to sleeve 34 near first end 31 of sleeve 34, which latching passage 54 is normally blocked by first land 21.

In steady-state operation, when current supplied to motor 12 is above a first pre-determined level, such as 0 and a second, higher, predetermined level, the pressures of the fluid in first pathway 40 and second pathway 42, together with the biasing force of spring 36 hold spool 18 in a relatively steady position with second inlet 50 blocked by land 25. In the event of a power interruption to motor 12, which reduces motor current to approximately 0, the null bias of motor 12 will tend to move spool 18 in the direction of arrow 58 or up as viewed in the FIGURE. This null bias position can be treated as a fail-safe position in which second inlet 50 and latching passage 54 are blocked by third land 25 and first land 21 respectively. During operation, the current provided to motor 12 varies between the first and second predetermined levels, and this varies the position of nozzle 16 and thus the pressures in first and second pathways 40, 42 to move spool 18 in the direction of arrow 60 or down in the drawing FIGURE to controllably and selectively open second inlet 50 to central channel 32.

Latching is achieved by sending a command (such as a full-rated current command or other current command outside a normal operating range, above the second predetermined level) to motor 12 and driving spool 18 far enough in the direction of arrow 60 to open latching passage 54 to chamber at 31. This increases pressure at first end 22 of spool 18 and drives spool 18 in the direction of arrow 60 and latches it in position. The diameter of the first portion 20 of spool 18 is sufficiently greater than the diameter of the second portion 24 of spool 18, that pressure PC in line 38 holds spool 18 in this second fail-safe position independently of the position of nozzle 16. Therefore, spool 18 remains latched in this second fail-safe position until pressure PC is dropped to a certain level. Therefore, further commands to torque motor 14 cannot unlatch the spool 18. This feature allows the valve to be commanded to a fail-safe position by a controller independently of the torque motor null bias and provides a second fail-safe position for the valve. Only after pressure PC decays to a necessary level can the position of spool 18 again be controlled by torque motor 12.

The present invention has been described above in terms of a presently preferred embodiment; however, obvious additions and changes to this embodiment will become apparent to those skilled in the relevant arts upon a reading of the foregoing description. It is intended that all such obvious modifications and additions comprise a part of the present invention to the extent they fall within the scope of the several claims appended hereto.

What is claimed is:

1. An electro-hydraulic servovalve (EHSV) comprising:

a nozzle;

a motor operably connected to the nozzle for controlling the position of the nozzle;

a spool having first and second ends slidably mounted in a sleeve having first and second ends and a first land near said spool first end;

a first passage extending from near said nozzle to the first end of said sleeve;

a second passage extending from near said nozzle to the second end of said sleeve; and a latching passage near said first end of said sleeve;

said motor having a null bias tending to direct said nozzle toward said second passage and said spool toward a first fail-safe position; and said first land blocking said latching passage when a current to said motor is below a predetermined level and said first land opening said latching passage to said sleeve first end when said current exceeds said predetermined level to drive said spool to a second fail-safe position different from said first fail-safe position.

2. The EHSV of claim 1 wherein said spool first end has a larger width than said spool second end.

3. The EHSV of claim 1 wherein said latching passage is in fluid communication with said nozzle.

4. The EHSV of claim 3 wherein fluid at a first pressure is applied against said first land and to said nozzle.

5. The EHSV of claim 2 including a spring biasing said spool toward said sleeve first end.

6. The EHSV of claim 1 further including a third fluid passage, wherein said spool includes a second land between said first land and said second end blocking said third fluid passage when said current is below said second predetermined level and exposing said third fluid passage to an EHSV outlet when said current is greater than said second predetermined level.

7. The EHSV of claim 3 wherein said spool includes a first lubrication channel and a second lubrication channel in fluid communication with and exposed to the pressure in said latching passage.

8. The EHSV of claim 2 wherein the area of said spool first end is sufficiently greater than the area of said spool second end that said spool remains latched in said second fail-safe position when said latching passage is open to said sleeve first end independently of current provided to said motor.

9. The EHSV of claim 1 wherein said spool includes a first portion including said first end having a first diameter and a second portion including said second end having a second diameter less than said first diameter, said sleeve includes a first portion including said sleeve first end and a second portion including said sleeve second end, and said spool further includes a central groove, a second land on said first portion between said first land and said central groove, a first lubricating channel between said first and second lands, third and fourth lands between said central groove and said second end and a second lubricating channel between said third and fourth lands.

10. The EHSV of claim 1 wherein said spool first end in said first fail-safe position is closer to said sleeve first end than said spool first end in said second fail-safe position.

11. An electro-hydraulic servovalve (EHSV) comprising:

a nozzle;

a motor operably connected to the nozzle for controlling the position of the nozzle based on current provided to the motor;

a spool having first and second ends slidably mounted in a sleeve having first and second ends and a first land near said first end;

a first passage extending from near said nozzle to the first end of said sleeve;

a second passage extending from near said nozzle the second end of said sleeve;

said spool shifting to a first fail-safe position when said current is below a first predetermined level and latching in a second fail-safe position different than said first fail-safe position when said current exceeds a second predetermined level greater than said first predetermined level.

12. The EHSV of claim 11 including a latching fluid passage blocked by said first land when said current is less than said second predetermined level and open to said sleeve first end when said current exceeds said second predetermined level.

13. The EHSV of claim 12 wherein, after latching in said second fail-safe position, the pressure of fluid in said latching fluid passage holds said spool in said second fail-safe position independently of said current.

14. An electro-hydraulic servovalve (EHSV) comprising:

a nozzle;

a motor operably connected to the nozzle for controlling the position of the nozzle based on a current provided to said motor;

a spool having first and second ends, a first portion of said spool including said first end and having a first diameter and a second portion of said spool including said second end and having a second diameter less than said first diameter, said spool being slidably mounted in a sleeve having a first portion having a first end opposed to said spool first end and a second portion having a second end opposed to said spool second end, said spool further including a central groove, first and second lands on said first portion between said first end and said central groove, a first lubricating channel between said first and second lands, third and fourth lands between said central groove and said second end, and a second lubricating channel between said third and fourth lands;

a first passage extending from near said nozzle to the first end of said sleeve;

a second passage extending from near said nozzle the second end of said sleeve;

a third passage extending from near said nozzle through said central channel and to an outlet;

a latching passage connected to said sleeve first portion; and a fourth passage connected to said sleeve second portion;

said spool being shiftable between a first fail-safe position, an operating position, and a second fail-safe position, wherein:

said first land blocks said latching passage and said third land blocks said fourth passage when said spool is in said operating position, said third land blocks said fourth passage when said spool is in said first fail-safe position, and said latching passage is open to said sleeve first portion and said fourth passage is open to said central channel when said spool is in said second fail-safe position.

* * * * *